United States Patent [19]

Ohtani

[11] 4,349,267

[45] Sep. 14, 1982

[54] PROCESSING SOLUTION CIRCULATING DEVICE FOR FILM PROCESSOR

[75] Inventor: Masami Ohtani, Kyoto, Japan

[73] Assignee: Dainippon Screen Mfg. Co., Ltd., Kyoto, Japan

[21] Appl. No.: 240,109

[22] Filed: Mar. 3, 1981

[30] Foreign Application Priority Data

Mar. 26, 1980 [JP] Japan ..... 55-40836[U]

[51] Int. Cl.[3] ..... G03D 3/06

[52] U.S. Cl. ..... 354/323; 354/324; 354/325; 137/563; 137/577

[58] Field of Search ..... 354/324, 325, 323; 137/563, 577

[56] References Cited

U.S. PATENT DOCUMENTS

| | | | |
|---|---|---|---|
| 2,989,911 | 6/1961 | Winnek | 354/323 |
| 3,733,994 | 5/1973 | Armstrong et al. | 354/324 |
| 4,012,753 | 3/1977 | Schmidt | 354/324 |
| 4,081,816 | 3/1978 | Geyken et al. | 354/324 |
| 4,171,716 | 10/1979 | Szabo et al. | 354/324 |

*Primary Examiner*—Richard A. Wintercorn
*Assistant Examiner*—Alan Mathews
*Attorney, Agent, or Firm*—Brumbaugh, Graves, Donohue & Raymond

[57] ABSTRACT

The first and the second circulation pipe systems are respectively and circularly connected to a tray which a processing solution is supplied into, respective pumps to pump up the processing solution, respective containers which a circulated processing solution is retrieved into, and an over-flow unit to keep the level of a processing solution supplied into the tray at desired level, the over-flow unit being provided to the opening of the bottom of the tray. In the respective circulation pipe systems, valves for switching over between the systems are further provided, alternatively to circulate a desired processing solution by controlling the valves.

7 Claims, 3 Drawing Figures

PROCESSING SOLUTION CIRCULATING DEVICE FOR FILM PROCESSOR

BACKGROUND OF THE INVENTION

The present invention relates to a processing solution circulating device to be provided in a film processor so as to facilitate replacement of the processing solution, such as developer. An exposed photographic film is treated through several steps, such as developing, stopping, fixing, washing and drying automatically in sequence, in a film processor. This invention relates particularly a processing solution circulating device for a continuous transfer type film processor in which a film is transfered continuously through the foregoing processes, and respective processings are performed during the transfer, and the film is discharged after a series of the processes. That is, this invention is applicable to a film processor of such type that the respective processings of development, fixing and washing are carried out by passing an exposed film through the processing solutions respectively supplied to the processing trays.

This type of film processor has been generally composed of four processing trays and a transfer mechanism thereto. The trays are arranged in parallel, and used as the developing, fixing, first washing and second washing trays in order from the insertion side of films, where a stop solution tray can be located between the developing tray and the fixing tray, if necessary, and also a drying equipment can be installed at the back of the second washing tray. The transfer mechanism is provided thereto to feed films from the inlet through the foregoing processes one after another, and to discharge the films from the outlet.

Ordinarily, several kinds of processing solutions have to be used depending on the type of the film to be processed. For example, a processing solution used for a high contrast lithtype film which is developed in a striking between black and white is different from one used for a continuous tone film of a regular contrast which is developed in continuous shading from white to black. Prior to treatments for a film, therefore, the processing solution to be supplied in the developing tray, i.e. the developer must be changed suitably to each type of films.

Wash-off type films are treated only through two processings, developing by the solution mixed with activator and washing, in place of the developing, stopping, fixing, first washing and second washing for ordinary films. For wash-off type films, therefore, it is necessary to supply a solution mixed with activator to the first washing tray used for processing of ordinary films so as the film is transfered directly to the activator processing tray in which the film is developed while skipping over the processes of developing, stopping and fixing of the film processor. Therefore, the processing solution must be replaced if a film processor is used for processing of ordinary films and also of wash-off type films.

Replacement of processing solutions has so far been made through the following procedure primarily by hands: discharging of processing solution through a drain pipe attached to the bottom of a processing tray to be retrieved into the first container in which the processing solution is stocked for future use, taking the container out of the film processor, washing off the tray after placing the second container into which the waste water is retrieved, and replacing the second container with the third container containing another processing solution.

The wash-off type films mentioned above have become popular and been applied in many fields because of simplicity in operation. Replacement of the washing water to be supplied into the first washing tray with the activator processing solution which is utilized for the wash-off type films, however, has be made frequently, in addition to the exchanging operations of trays. As the necessity of utilizing wash-off type films increases, replacement of processing solutions for film processor as described above becomes more frequent.

BRIEF SUMMARY OF THE INVENTION

In view of the foregoing, it is a general object of this invention to provide a processing solution circulating device which enable quick and easy replacement of the processing solutions corresponding to respective type of films that require various solutions or treatments.

The above and further objects and novel features of the invention will more fully appear from the following detailed description when the same is read in connection with the accompanying drawings. It is to be expressly understood, however, that the drawings are for purpose if illustration only and is not intended as a definition of the limits of the invention.

DETAILED DESCRIPTION OF THE INVENTION

Construction

Figure 1:
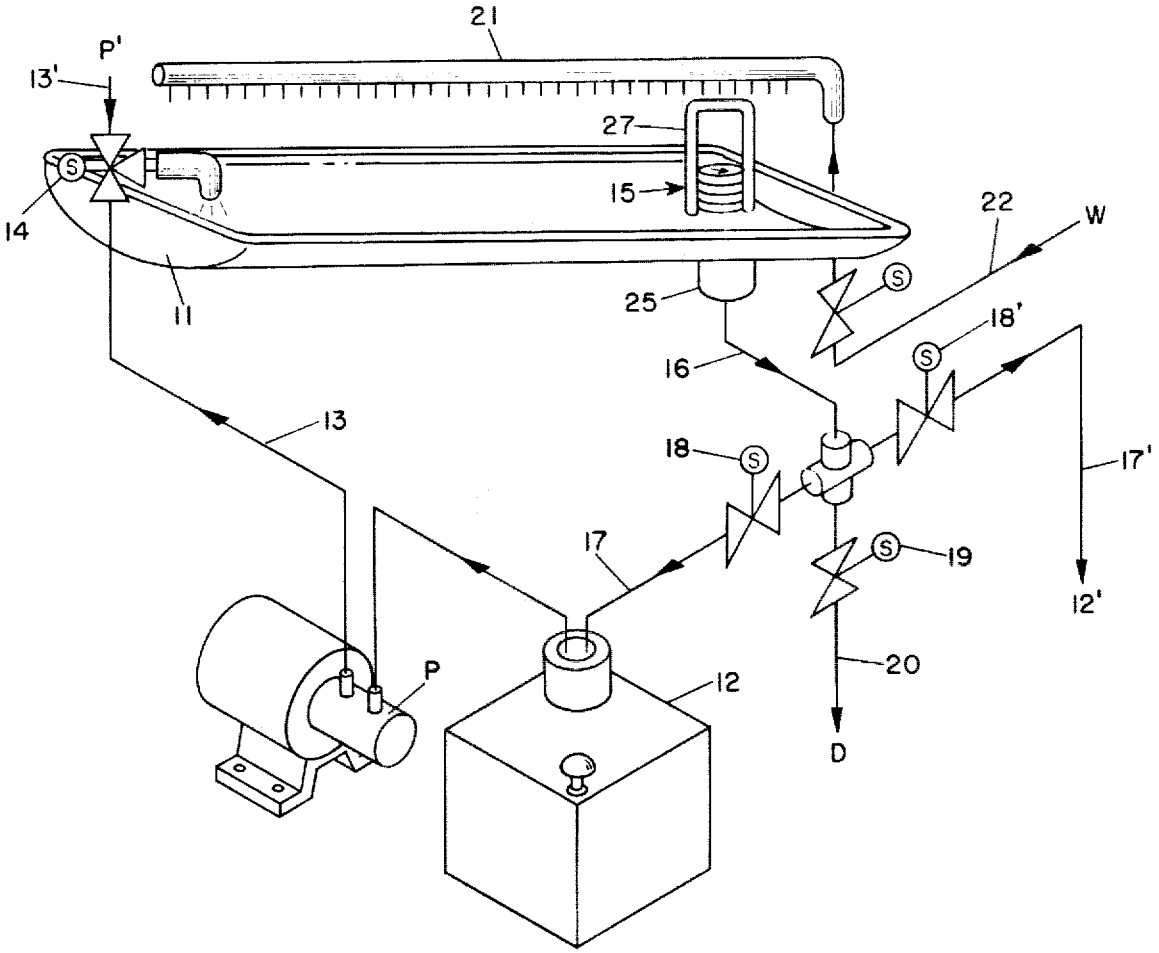
FIG. 1 is an explanatory drawing of an embodiment according to the invention to show the basic composition.
Figure 3:
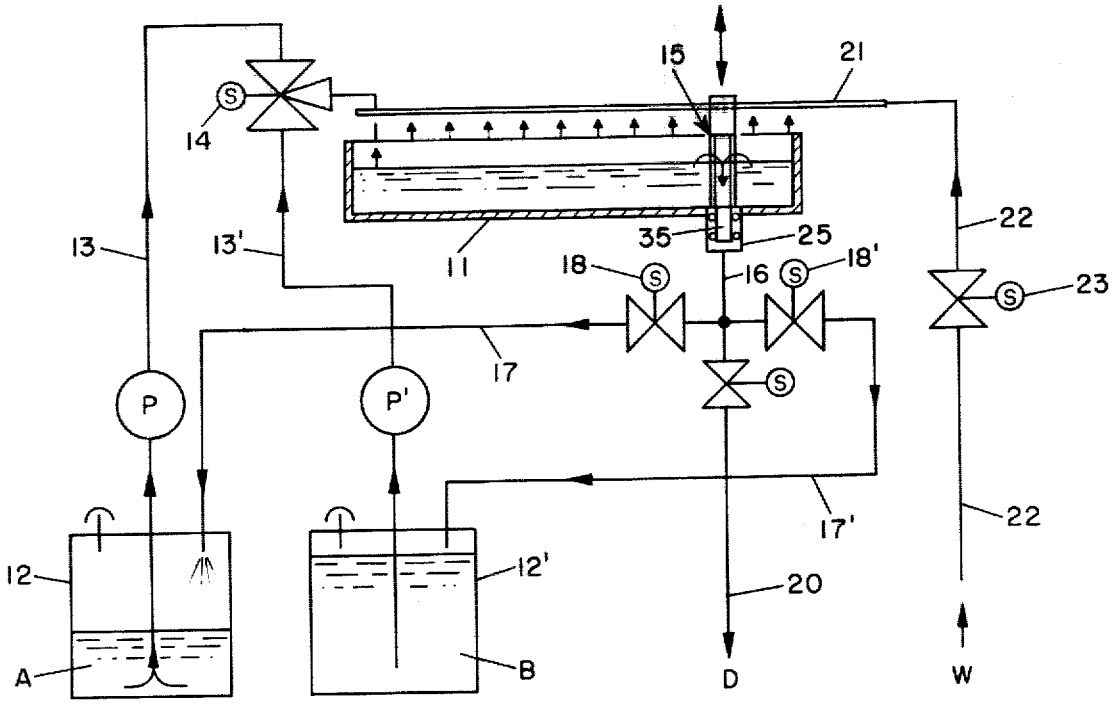
FIG. 3 is a circuit diagram of the device according to this invention.

Referring to FIGS. 1 and 3, a processing tray 11 into which a developer is supplied is fixed at the specified position of the developing unit of the film processor. Containers 12, 12' are respectively filled with developers A, B which are different each other. The developer A or B is respectively pumped up by a pump P or P' and is conducted to the three-way solenoid valve 14 through a feed pipe 13 or 13'. An over-flow unit 15 is provided to the bottom of the tray 11, which keeps the developer A or B supplied in the tray 11 at a constant level. The discharge pipe line 16 is connected to the over-flow unit 15 and to magnetic switch valves 18, 18'. Return pipe lines 17, 17' are respectively connected to the valves 18, 18' and to the container 12, 12'. Thus the device illustrated in FIGS. 1 and 3 has two circulation pipe systems to circulate a respective processing solution. It is also possible, of course, to provide further circulation pipe systems in this device. On the other hand, another magnetic switch valve 10 is attached between the discharge pipe line 16 and a drain pipe line 20. And a shower pipe 21 is provided at approximately upper the processing tray 11 along the longitudinal direction, to wash the tray 11. Washing water W is conducted to the shower pipe 16 through a feed pipe line 22, in which a magnetic switch valve 23 is attached to the pipe line 22 to control the washing water W. After washing of the tray 11 by the washing water W, the waste water supplied from the shower pipe 21 is discharged to the drain D through the discharge pipe line 16 and a drain pipe line 20, in which a magnetic switch valve 19 is also attached between them to control the draining.

Figure 2:
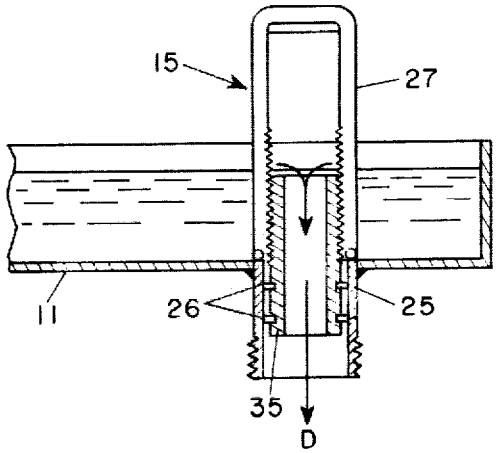
FIG. 2 is a partial sectional view of FIG. 1.

Referring to FIG. 2, the foregoing over-flow unit 15 is comprised of an outer pipe 25, O-rings 26, a handle 27 and an inner pipe 35. The outer pipe 25 is connected to the discharge pipe line 16 and is fixed to the bottom of the processing tray 11. The inner pipe 35 which has openings at both upper and lower ends is inserted into the outer pipe 25 so as to be mounted and dismounted freely in vertical direction. O-rings 26 are provided at the ring grooves formed on the lower periphery of the inner pipe 35 to seal off the gap between the inner pipe 35 and the outer pipe 25 serving to prevent leakage from the gap. The handle 27 is mounted to insert or pull out the inner pipe 35 into or from the outer pipe 25 by turning the handle 27 because a screw is respectively provided on the inner side of the handle 27 and on the outer periphery of the inner pipe 35, to engage with each other. The lower end of the handle 27 functions as the stopper for the upper end of the inner pipe 35 i.e. as the stopper to limit the height of the over-flow level. It is naturally so arranged that the handle 27 may not interfere with the shower pipe 21 when the inner pipe 35 is inserted or pulled out. The over-flow unit 15 is positioned at the opposite side of the processing solution supply, as illustrated in FIGS. 1 and 3.

Operation

At the developing unit of a film processor, the developer A is pumped out from the container 12 by the pump P to sent out to the feed pipe line 13 and is supplied to the processing tray 11 through the three-way solenoid valve 14. When the supplied developer A fills the processing tray 11 and the level reaches the over-flow level of the inner pipe 35, the developer flows into the inner pipe 35 and the level of the developer in the tray 11 is kept at a constant level. The over-flowing developer returns to the container 12, as a free flow, through the discharge pipe line 16, the magnetic switch valve 18 and the return pipe line 17, to be circulated again through the foregoing route. Now to replace the developer A with the developer B, the developer A supplied in the processing tray 11 must be recovered to the container 12. For the retrieval of the developer A, the pump P is suspended, and the three-way solenoid valve 14 is closed at the same time to prevent supply of the developer A to the tray 11. Then pull out the inner pipe 35 from the outer pipe 25 by turning the handle 27, and the developer A remaining in the processing tray 11 is retrieved into the container 12 almost completely through the discharge pipe line 16, magnetic switch valve 18 and the return pipe line 17 as described above. Then close the magnetic switch valve and open the switch valve 19 at the same time, as well as the switch valve 23, and the washing water W supplied to the feed pipe line 22 is conducted to the shower pipe 21 through the magnetic switch valve 23 to be injected from the nozzle and blasted against the inner wall of the processing tray 11 to wash it off. The waste water is discharged to the drain pipe line 20 through the discharge pipe line 16 and the magnetic switch valve 19. At the end of the washing, the magnetic switch valve 23 is closed and then the magnetic switch valve 19 is also closed. After that, the inner pipe 35 is inserted into the outer pipe 25 again and is set at the specified position. Then the developer B is supplied into its pipe system. That is, the pump P' is operated, the three-way solenoid valve 14 is switched, and the developer B is pumped out from the container 12' by the pump P' to supply it to the tray 11 through the feed pipe line 13' and the three-way solenoid valve 14. When the processing tray 11 is filled to preset level with the developer B, it over-flows into the discharge pipe line 16, in the same manner as described above, and returns to the container 12' through the magnetic switch valve 18' and further through the return pipe line 17'.

Thus the replacement of the developer A with that B completes. For replacement of the developer B with that A in reverse, the foregoing operation may be applied. In the above operation for replacement, the inner pipe 35 is to be inserted and removed manually by the handle 27, but the operation can be made automatic easily by setting a pneumatic cylinder at an adequate position over the over-flow unit 15 and by interlocking the operation rod with the handle 27. It is also possible to attach this device to the first washing tray for processing of a wash-off type film. To change the washing tray for ordinary films to the tray for wash-off type films, or to change them in reverse way, it may as well simply to connect the feed pipe line 13' to the washing water feed pipe directly and no container nor pump is required. Since the operation for replacement in this case is made almost in the same way as described above, no further explanation is given here.

In the composition shown in the circuit diagram of FIG. 3, automatize the operation of the over-flow unit 15 as described above, incorporate the sequence circuit for replacement of the processing solutions to the tray 11, and provide interlock adequately in the circuit, then the operation can be made all-automatic only by pushing the specific start switch with no interference among the foregoing operations.

In the embodiment, two kinds of processing solutions A, B are replaced each other, but it is also possible, as a matter of course, to compose this device for replacement of an increased number of different solutions.

As it has been made clear by the foregoing description, the film processor provided with the processing solution circulating device according to this invention has an over-flow unit to keep the level of the processing solution in the tray at a constant level, and the over-flow unit is so mounted to be dismounted freely as desired onto the discharge pipe which is attached to the bottom of the processing tray. In replacing the processing solutions, therefore, the processing solution filled in the tray can be retrieved exactly into the container through the return pipe line which can be connected to the discharge pipe by switching when the over-flow unit is pulled out. Then the empty processing tray can be washed up, and the waste water can be discharged completely to the drain pipe line which can be switched for connection to the discharge pipe, and then the processing tray can be filled with another processing solution up to a certain level by setting the over-flow unit again. Accordingly, by automating the mounting and dismounting operation of the over-flow unit, replacement of the processing solutions can be carried out by this device as a series of sequence operation more quickly and easily.

Thus a processing solution circulating device which is applicable to various types of films for various kinds of processing solutions can be offered.

What is claimed is:

1. A device for circulating at least two processing solutions through a tray comprising:

reservoir means for separately containing said processing solutions;

overflow means mounted on an opening on the bottom of said tray and including means for variably positioning said overflow means to control the level of said processing solutions in said tray at a desired level;

at least two circulation means circularly connected between said overflow means and said tray through said reservoir means, each of said circulation means connected to one of said processing solutions; and switching means for selectively connecting each of said circulation means to said tray to supply said processing solutions to said tray.

2. The device of claim 1 and further comprising a handle associated with said variably positioning means for controlling the height of said overflow means.

3. A device for circulating a processing solution according to claim 1 in which said overflow means is comprised of an outer cylinder and an inner one, said inner cylinder being firmly inserted into said outer one and being removable from said outer one.

4. A device for circulating a processing solution according to claim 3 in which a handle for controlling the height of said over-flow means and for dismounting said inner cylinder from said outer one is attached to said inner cylinder.

5. A device for circulating a processing solution according to claim 4 or 2 in which screws being engaged with each other are respectively provided on the outer surface of said inner cylinder and the inner surface of said handle opposite to said cylinder.

6. A device for circulating a processing solution according to claim 1 further comprising washing means for washing the inner surface of said tray and a drain pipe system to drain the waste water, said drain pipe system being connected to said overflow means.

7. A device for circulating a processing solution according to claim 6 in which either any one of said circulation pipe systems or said drain pipe system is circulated by controlling said switching means.

* * * * *